US005904627A

United States Patent [19]

Miyaji et al.

[11] Patent Number: 5,904,627

[45] Date of Patent: May 18, 1999

[54] GOLF CLUB SHAFT

[75] Inventors: Toshihiro Miyaji, Kagawa-ken; Atsushi Takeda, Takamatsu; Masahiko Fujiwara, Kagawa-ken, all of Japan

[73] Assignee: Kasco Corporation, Kagawa-ken, Japan

[21] Appl. No.: 08/837,889

[22] Filed: Apr. 22, 1997

[30] Foreign Application Priority Data

May 1, 1996 [JP] Japan ..... 8-110767

[51] Int. Cl.[6] ..... A63B 53/10; A63B 53/12

[52] U.S. Cl. ..... 473/319; 473/321; 473/323

[58] Field of Search ..... 473/316–323, 473/296, 298, 239

[56] References Cited

U.S. PATENT DOCUMENTS

| | | | |
|---|---|---|---|
| Re. 19,731 | 10/1935 | Hackett | 473/316 |
| 1,535,719 | 4/1925 | Fisher | 473/296 |
| 1,968,616 | 7/1934 | Oldham | 473/298 |
| 2,250,428 | 7/1941 | Vickery | 473/323 |
| 2,757,002 | 7/1956 | Ryden | 473/296 |
| 4,319,750 | 3/1982 | Roy | 273/DIG. 23 |
| 4,674,747 | 6/1987 | Mazzocco | 473/296 |
| 4,836,545 | 6/1989 | Pompa | 473/320 |
| 4,932,661 | 6/1990 | Choi | 473/239 |
| 5,018,735 | 5/1991 | Meredith | 473/318 |
| 5,282,619 | 2/1994 | Napolitano | 473/296 |
| 5,575,473 | 11/1996 | Turner | 473/298 |
| 5,620,380 | 4/1997 | Tennent | 473/319 |
| 5,626,529 | 5/1997 | Roy | 473/319 |

FOREIGN PATENT DOCUMENTS

| | | |
|---|---|---|
| 6-26638 | 4/1994 | Japan . |
| 2 273 055 | 6/1994 | United Kingdom . |

*Primary Examiner*—Steven Wong
*Assistant Examiner*—Stephen L. Blau
*Attorney, Agent, or Firm*—Oblon, Spivak, McClelland, Maier & Neustadt, P.C.

[57] ABSTRACT

A golf club shaft comprises three interconnected tubular members whose diameters, flexional rigidities, lengths, materials, etc. are selected to make the golf club shaft more flexible near a club head or a club grip or at a middle portion.

24 Claims, 9 Drawing Sheets

GOLF CLUB SHAFT

BACKGROUND OF THE INVENTION

1. Field of the Invention

The present invention relates to a golf club shaft which comprises at least three successive tubular members axially joined together.

2. Description of the Related Art

One type of golf club shaft that has recently been finding widespread use among golf players comprises a tubular body of fiber-reinforced synthetic resin which extends from a butt end as a grip support toward a tip end as a head support. The golf club shaft that is used generally is of a tapered shape whose diameter gradually decreases from the butt end toward the tip end.

The golf club shaft of fiber-reinforced synthetic resin is manufactured by a sheet winding process. According to the sheet winding process, a partly hardened prepreg sheet which is made of fibers impregnated with synthetic resin is wound around a tapered mandrel, and then heat-set to shape. Because the diameter of the shaft varies in the axial direction, the flexional rigidity of the shaft is progressively smaller from the butt end toward the tip end. The rate at which the flexional rigidity of the shaft varies may be changed by increasing or reducing the taper of the shaft, but cannot largely be changed. This imposes a limitation on efforts to place the bending point, i.e., the point of maximum flexibility of the shaft, near the butt end, making the shaft more flexible near the club grip, or near the tip end, making the shaft more flexible near the club head. Therefore, the golf club shaft has no sufficient freedom for design.

Golf clubs that are more flexible near the club grip or the shaft butt end can store energy upon a swing, and hence can produce a powerful ball hit. On the other hand, golf clubs that are more flexible near the club head or the shaft tip end can hit a ball at a large angle and hence along a high trajectory. For this reason, some golf players prefer golf clubs that are more flexible near the club head. However, the conventional golf club shafts made of fiber-reinforced synthetic resin have failed to satisfy such needs of golf players.

Attempts have been made to manufacture a golf club shaft of fiber-reinforced synthetic resin whose local flexional rigidity is largely changed by introducing, between the butt and tip ends thereof, a shaft portion which is thinner or thicker than the butt and tip ends or a shaft portion which has an abrupt increase or reduction in diameter compared with the butt and tip ends.

The sheet winding process cannot be easily applied to make shaft portions of different diameters because it is difficult to wind a prepreg sheet around those shaft portions of different diameters.

According to another process, a prepreg sheet is wound around a tube of synthetic resin, and then the tube is placed in a mold having a mold cavity in the shape of a golf club shaft. Thereafter, air is introduced into the tube to exert an internal pressure thereto while the tube is being heat-set to shape. This process is, however, disadvantageous in that the tube tends to become lower in mechanical strength in regions where it is largely expanded under the internal pressure, and the tube is liable to suffer shape failures.

SUMMARY OF THE INVENTION

It is a general object of the present invention to provide a golf club shaft which has sufficient freedom to design, allows flexional rigidity to be largely changed locally, and can easily be manufactured.

A main object of the present invention is to provide a golf club shaft which may easily be made more flexible near a butt end, a tip end, or an intermediate portion thereof.

Another object of the present invention is to provide a golf club shaft which has a sufficient degree of mechanical strength.

Still another object of the present invention is to provide a golf club shaft which is free of shape failures when it is manufactured.

A golf club shaft according to the present invention comprises at least three tubular members axially joined and fixed together. The three tubular members include a tubular member as a butt end tubular member, a tip end tubular member, and a middle tubular member between the but and tip end tubular members. The butt end tubular member has a flexional rigidity greater than the flexional rigidity of the tip end tubular member. Each of the tubular members comprises a plurality of layers of fiber-reinforced synthetic resin which are integral from one end to the other, and may also have a local reinforcing layer. The tubular members can be manufactured by a sheet winding process, a filament winding process, or the like which is known in the art.

A club grip will be mounted on the butt end tubular member, and a hosel for a club head will be mounted on the tip end tubular member. Therefore, the butt end tubular member (hereinafter referred to as a "tubular member Sb") has an outside diameter greater than the outside diameter of the tip end tubular member (hereinafter referred to as a "tubular member St"). The middle tubular member (hereinafter referred to as a "tubular member Sm") has an outside diameter which can freely be selected insofar as it will not present disadvantages when the golf club shaft is assembled. For example, the outside diameter of the tubular member Sm may be larger than the outside diameter of the tubular member Sb or smaller than the outside diameter of the tubular member St.

The golf club shaft according to the present invention requires that the flexional rigidity of the tubular member Sb be larger than the flexional rigidity of the tubular member St. Over the entire length of the tubular member, the flexional rigidity is represented by the product of the modulus of longitudinal elasticity and the geometrical moment of inertia at a transverse section of the tubular member. If the tubular member is made of the same material and has the same wall thickness, then the flexional rigidity thereof is greater as the outside diameter is larger. According to the present invention, since the tubular members may not necessarily be made of the same material and may not necessarily have the same wall thickness, it is possible to make the flexional rigidity of the tubular member Sb whose outside diameter is large smaller than the flexional rigidity of the tubular member St whose outside diameter is small. However, no sufficient golf club performance may not be obtained with such flexional rigidity settings. For example, a golf club having a shaft in which the flexional rigidity of the tubular member Sb is smaller than the flexional rigidity of the tubular member St may not hit a ball in an exact direction or may slow a head speed.

The flexional rigidity of the tubular member Sm may freely be selected insofar as it does not impair the shaft performance. For example, the flexional rigidity of the tubular member Sm may be greater than the flexional rigidity of the tubular member Sb or smaller than the flexional rigidity of the tubular member St.

The length of each of the tubular members Sb, Sm, St is at most about 60% of the overall length of the golf club shaft. For example, if the golf club shaft has an overall length of 1200 mm, then it is preferable that the tubular member Sb have a length of at least about 250 mm, the tubular member Sm have a length of at least about 200 mm, and the tubular member St have a length of at least about 300 mm. Each of the tubular members Sb, Sm, St may be of a tapered shape whose outside diameter is progressively smaller from one end to the other, or of a parallel straight shape whose outside diameter remains the same from one end to the other. When the tubular members Sb, Sm, St are axially joined and fixed together, it is customary to overlap ends of the tubular members Sb, Sm, St. However, ends of the tubular members Sb, Sm, St may have thin wall portions which overlap each other so that the overlapping ends of the tubular members Sb, Sm, St may not be unduly thick.

The weights, wall thicknesses, torsional rigidities, and other attributes of the tubular members Sb, Sm, St may be set to suitable values depending on the nature of a golf club shaft that is desired.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
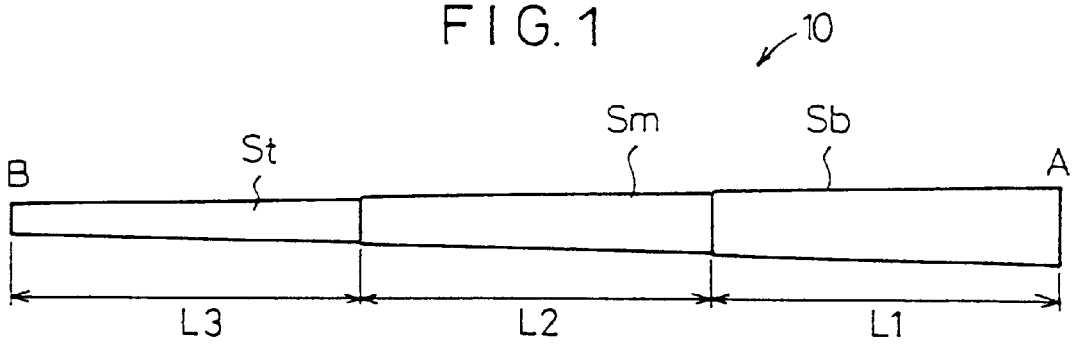
FIG. 1 is an elevational view of a golf club shaft according to a first embodiment of the present invention.

FIG. 1 shows a golf club shaft 10 according to a first embodiment of the present invention. In FIG. 1, the golf club shaft 10 is shown exaggerated with the outside diameter being large compared with the length of the shaft, rather than to actual dimensions.

Figure 2A:
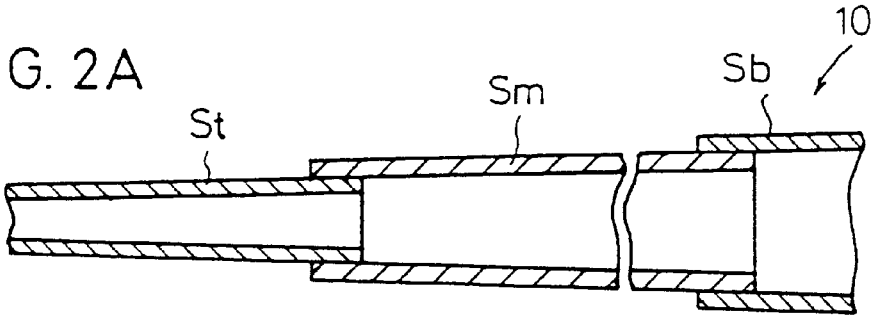
FIGS. 2A and 2B are enlarged fragmentary longitudinal cross-sectional views of the golf club shaft according to the first embodiment and a modification thereof.

The golf club shaft 10 is a driver shaft, and comprises three tubular members Sb, Sm, St which respectively provide a butt end on which a club grip will be mounted, a middle portion, and a tip end on which a hosel for a club head will be mounted. The tubular members Sb, Sm, St are each constructed of a plurality of fiber-reinforced synthetic resin layers produced by the sheet winding process, and are of a tapered shape whose diameter is progressively reduced from an end A where the club grip will be installed toward an end B where the club head will be installed. As shown in FIG. 2A, the tubular members Sb, Sm, St are joined together with their mating ends overlapping each other, and fixed together by an adhesive.

The tubular members Sb, Sm, St can easily be joined together by inserting the tubular member Sm into the tubular member Sb from the end A thereof until the tubular member Sm projects in its most part from the opposite end of the tubular member Sb, and inserting the tubular member St into the tubular member Sm from the end A of the tubular member Sb until the tubular member St projects in its most part from the opposite end of the tubular member Sm.

Figure 2B:
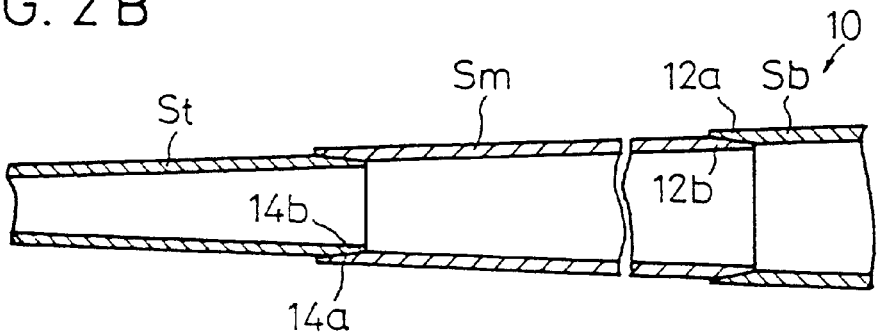

As shown in FIG. 2B, the mating ends of the tubular members Sb, Sm, St may have tapered thin wall portions 12*a*, 12*b*, 14*a*, 14*b* which fit together to minimize any steps on the outer circumferential surface of the golf club shaft 10.

In the first embodiment, the tubular members Sb, Sm, St have respective lengths L1, L2, L3 each of 400 mm. Usually, the driver shaft has a length smaller than 1200 mm, and hence will be cut off at the butt end or the tip end when used. The end A of the tubular member Sb has an outside diameter of 15.25 mm, and the end B of the tubular member St has an outside diameter of 8.5 mm. Each of the tubular members Sb, Sm, St has a wall thickness of about 1.2 mm.

Figure 3:
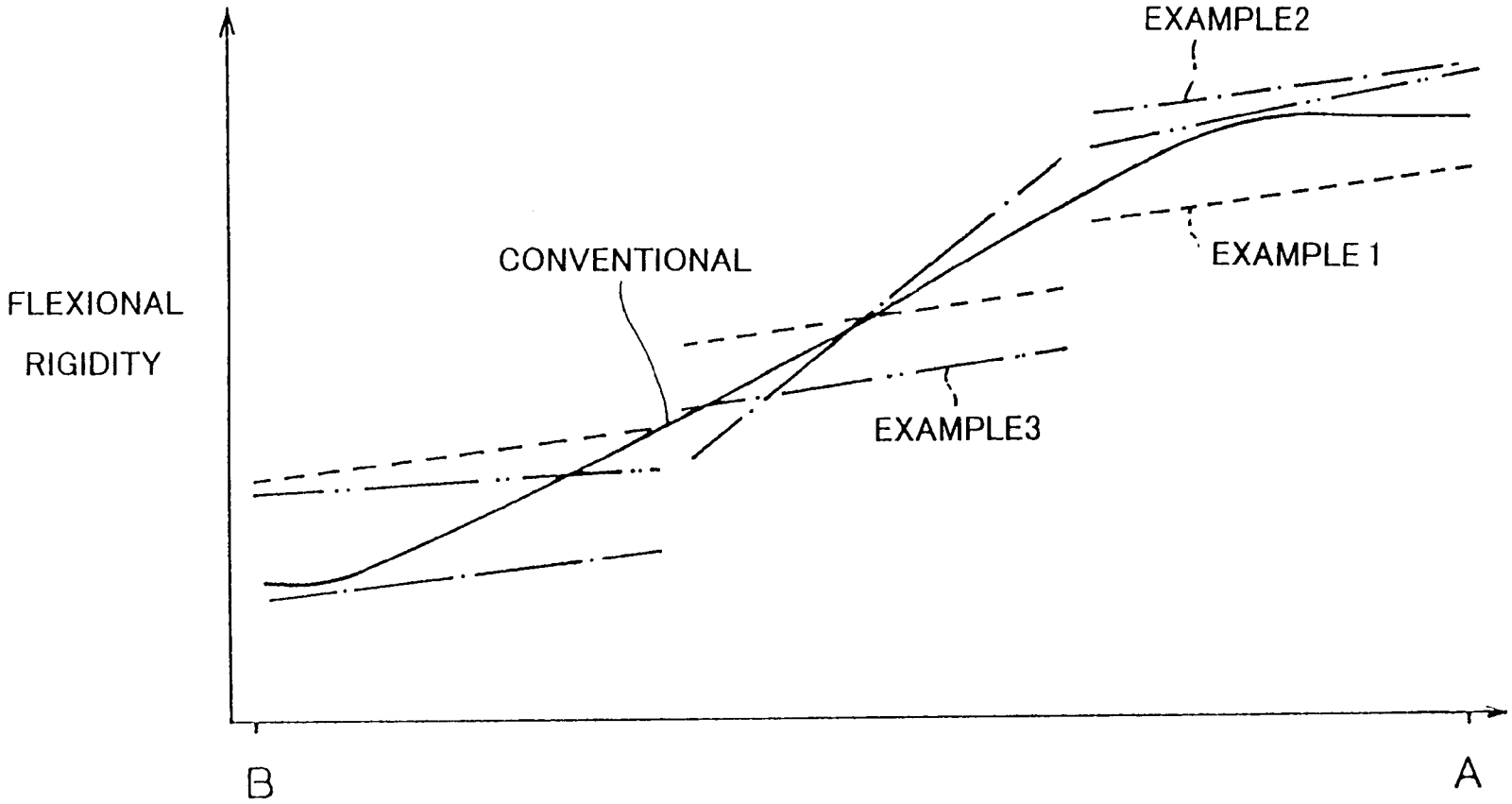
FIG. 3 is a diagram illustrative of the flexional rigidities of golf club shafts according to examples 1~3 of the first embodiment and a conventional golf club shaft.

FIG. 3 shows for comparison the flexional rigidities of golf club shafts according to examples 1~3 of the golf club shaft 10 of the first embodiment and a conventional golf club shaft which comprises a single tapered tubular body. The flexional rigidity of the golf club shaft according to the example 1 is indicated by the dotted-line curve. The flexional rigidity of the golf club shaft according to the example 2 is indicated by the dot-and-dash-line curve. The flexional rigidity of the golf club shaft according to the example 3 is indicated by the two-dot-and-dash-line curve. The flexional rigidity of the conventional golf club shaft is indicated by the solid-line curve. It is assumed that all the golf club shafts are flexed to the same degree. FIG. 3 does not show the flexional rigidities of overlapping ends of the tubular members Sb, Sm, St of the golf club shafts according to the examples 1~3.

In the golf club shaft according to the example 1, the flexional rigidity of the tubular member Sb (near the butt end) is smaller than the flexional rigidity of the butt end portion of the conventional golf club shaft, and the flexional rigidity of the tubular member St (near the tip end) is greater than the flexional rigidity of the tip end portion of the conventional golf club shaft. Therefore, the golf club shaft according to the example 1 is more flexible near the club grip compared with the conventional golf club shaft. In the golf club shaft according to the example 2, the flexional rigidity of the tubular member Sb (near the butt end) is greater than the flexional rigidity of the butt end portion of the conventional golf club shaft, and the flexional rigidity of the tubular member St (near the tip end) is smaller than the flexional rigidity of the tip end portion of the conventional golf club shaft. Therefore, the golf club shaft according to the example 2 is more flexible near the club head compared with the conventional golf club shaft. In the golf club shaft according to the example 3, the flexional rigidity of the middle tubular member Sm is smaller than the flexional rigidity of the middle portion of the conventional golf club shaft. Therefore, the golf club shaft according to the example 3 is more flexible at the middle portion compared with the conventional golf club shaft.

Figure 4A:
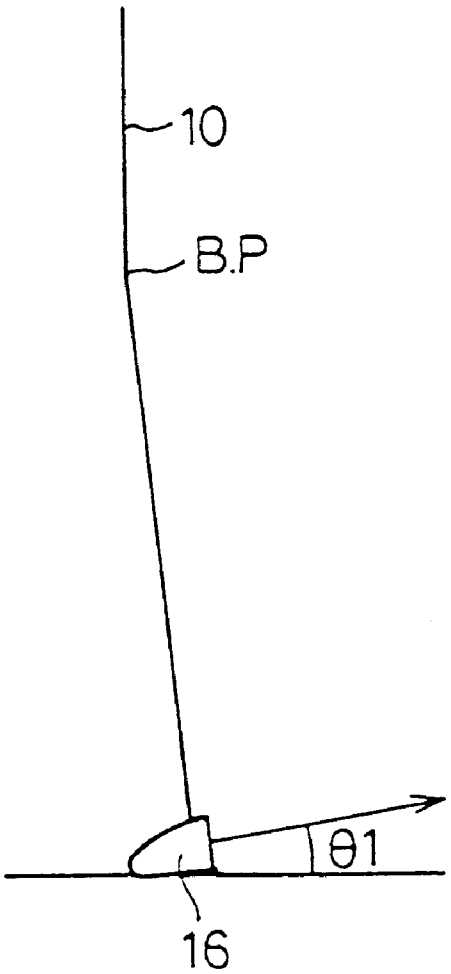
FIGS. 4A and 4B are diagrams showing the relationship between the position of a bending point on a golf club and the direction in which a ball is hit by the golf club.
Figure 4B:
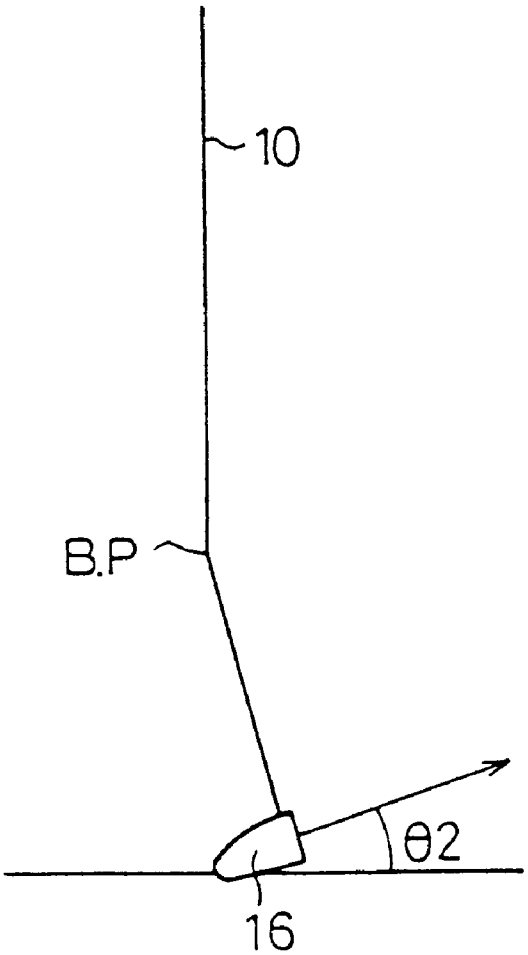

A golf club having the golf club shaft 10 which has a bending point near the butt end and hence is more flexible near the club grip, like the example 1, and a golf club having the golf club shaft 10 which has a bending point near the tip end and hence is more flexible near the club head, like the example 2, are compared with each other, as shown in FIGS. 4A and 4B. These golf clubs have their bending points BP positioned as shown in FIGS. 4A and 4B. Provided the golf club shafts flex to the same degree at their tip ends, the golf club shown in FIG. 4A can hit a ball at a smaller angle θ1 because the distance from the bending point BP to a club head 16 is smaller, and the golf club shown in FIG. 4B can hit a ball at a greater angle θ2 because the distance from the bending point BP to a club head 16 is greater. Accordingly, the golf club which is more flexible near the club grip can produce a powerful ball hit, and the golf club which is more flexible near the club head can hit a ball along a high trajectory.

With the conventional golf club shaft which comprises a single tubular body of fiber-reinforced synthetic resin, the position of the bending point BP can be changed only in a range of about 45 mm provided the tip end of the shaft flexes to the same degree. With the golf club shaft 10 according to the first embodiment, however, the position of the bending point can be changed in a wide range by selecting the diameters and the material of the golf club shaft as can be seen from the examples 1~3.

According to the examples 1~3, the three tubular members Sb, Sm, St are prepared for each of the golf club shafts according to the first embodiment. It is thus possible to prepare three sets of tubular members Sb, Sm, St of different flexional rigidities, and select any combination of three tubular members Sb, Sm, St from the total of nine tubular members. In this case, a choice is made available of 27 golf club shafts 10 having different flexional rigidity characteristics, for a golf player to choose from to meet his or her needs.

Figure 5:
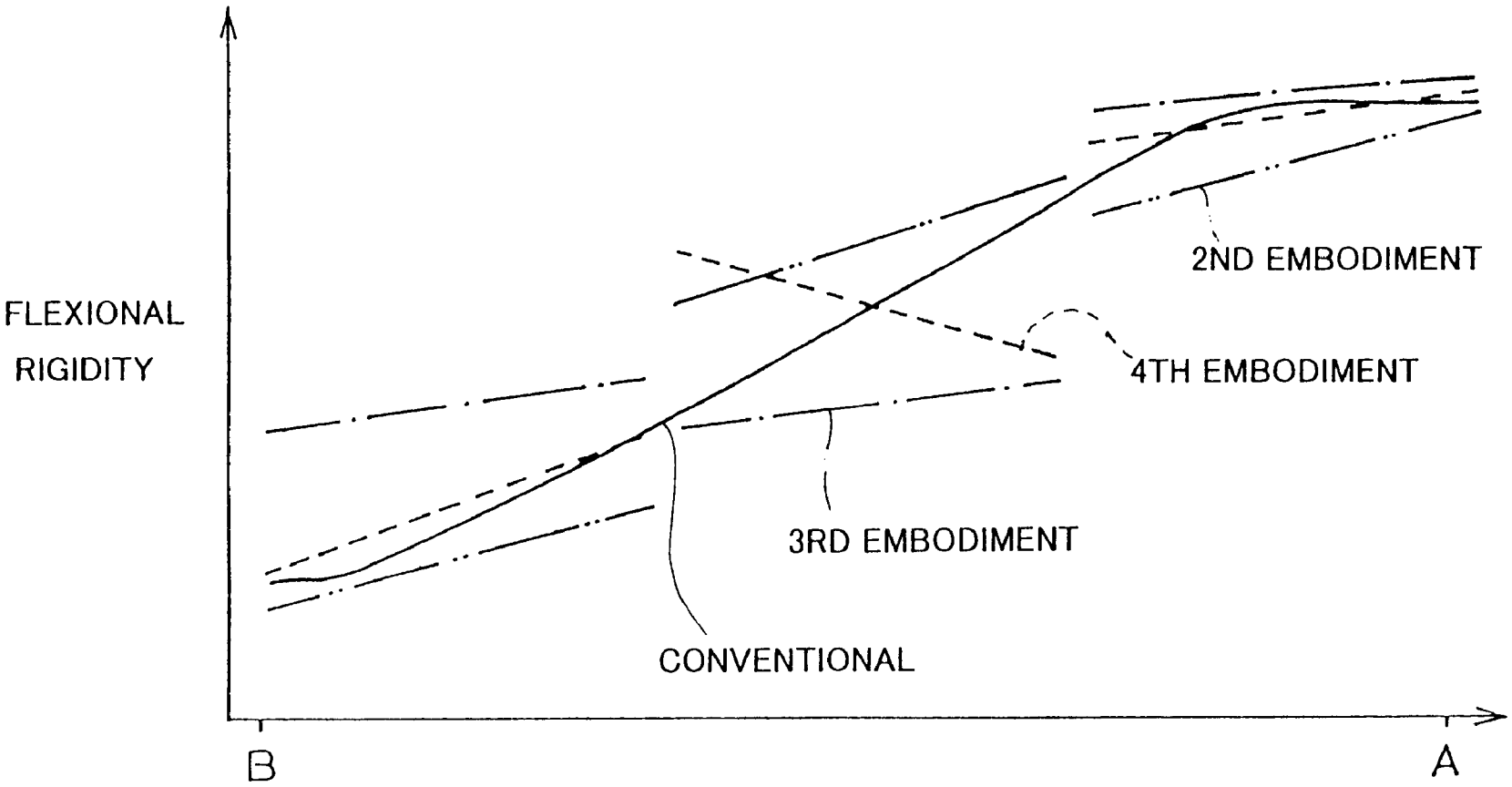
FIG. 5 is a diagram illustrative of the flexional rigidities of golf club shafts according to second, third, and fourth embodiments of the present invention and the conventional golf club shaft.

FIG. 5 are illustrative of the flexional rigidities of golf club shafts 18*a,* 18*b,* 18*c* (see FIGS. 6A~6C, respectively) according to second, third, and fourth embodiments of the present invention and the conventional golf club shaft. In the golf club shaft 18*a* according to the second embodiment, whose flexional rigidity is shown by the two-dot-and-dash-line curve, the flexional rigidity of the tubular member Sb (near the butt end) is smaller than the flexional rigidity of the butt end portion of the conventional golf club shaft whose flexional rigidity is shown by the solid-line curve, the flexional rigidity of the tubular member St (near the tip end) is also smaller than the flexional rigidity of the tip end portion of the conventional golf club shaft, and the flexional rigidity of the tubular member Sm (at the middle portion) is greater than the flexional rigidity of the middle portion of the conventional golf club shaft. In the golf club shaft 18*b* according to the third embodiment, whose flexional rigidity is shown by the dot-and-dash-line curve, the flexional rigidity of the tubular member Sb (near the butt end) is greater than the flexional rigidity of the butt end portion of the conventional golf club shaft, the flexional rigidity of the tubular member St (near the tip end) is also greater than the flexional rigidity of the tip end portion of the conventional golf club shaft, and the flexional rigidity of the tubular member Sm (at the middle portion) is smaller than the flexional rigidity of the middle portion of the conventional golf club shaft and also the flexional rigidity of the tubular member Sm of the golf club shaft 18*a* according to the second embodiment. It is therefore possible to make the flexional rigidity of an end portion of the tubular member Sb near the tubular member Sm smaller than the flexional rigidity of an end portion of the tubular member Sm near the tubular member Sb, or to make the flexional rigidity of an end portion of the tubular member St near the tubular member Sm greater than the flexional rigidity of an end portion of the tubular member Sm near the tubular member St.

Figure 6A:
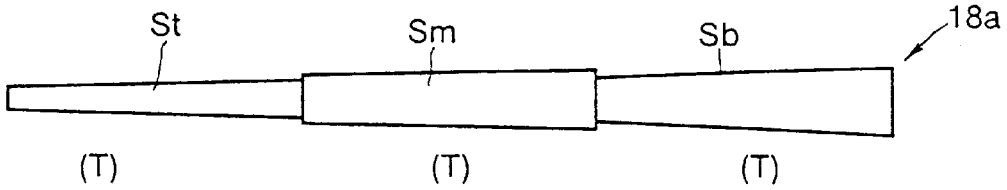
FIGS. 6A~6C are elevational views of the golf club shafts according to second, third, and fourth embodiments, respectively.
Figure 6B:
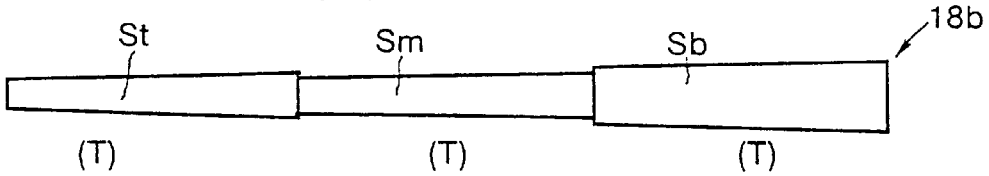
Figure 6C:
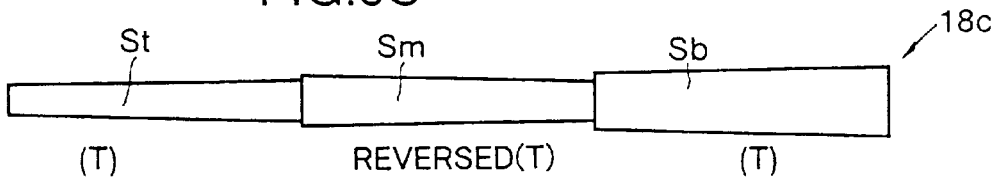

As shown in FIG. 6A, the middle tubular member Sm of the golf club shaft 18*a* according to the second embodiment has a relatively large diameter. As shown in FIG. 6B, the middle tubular member Sm of the golf club shaft 18*b* according to the third embodiment is relatively thin. As shown in FIG. 6C, the tubular member Sm of the golf club shaft 18*c* according to the fourth embodiment is inversely tapered, i.e., tapered toward the butt end whereas the other tubular members Sb, St are tapered toward the tip end. In FIGS. 6A~6C and also FIGS. 7A~7C, the tubular members Sb, Sm, St which are of a tapered shape are indicated by (T), and the tubular members Sb, Sm, St which are of a parallel straight shape are indicated by (P). The tubular members Sb, Sm, St are shown exaggerated, and not shown to actual directions.

Figure 7A:
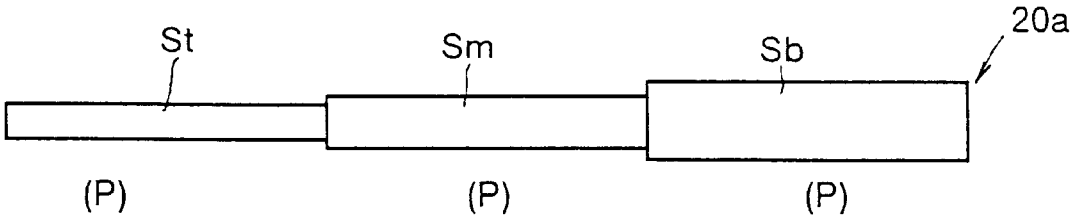
FIGS. 7A~7C are elevational views of golf club shafts according to fifth, sixth, and seventh embodiments, respectively, of the present invention.
Figure 7B:
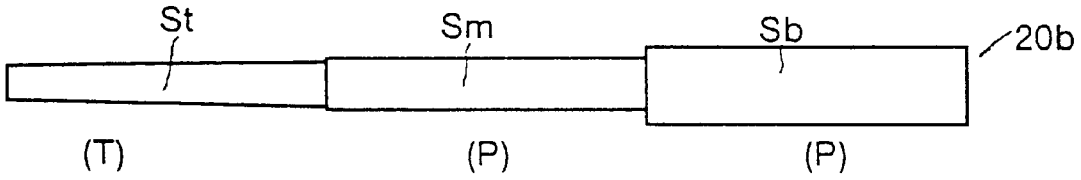
Figure 7C:
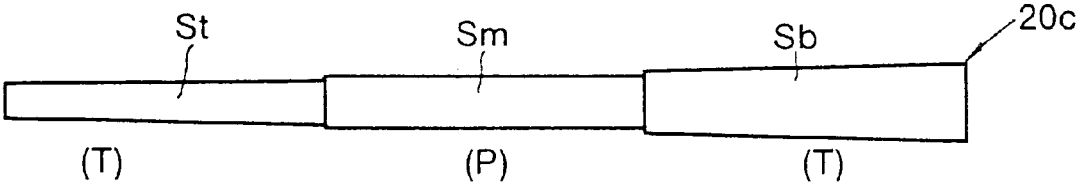
Figure 8A:
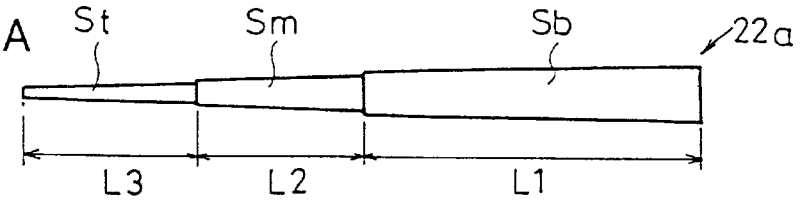
FIGS. 8A~8G are elevational views of golf club shafts according to eighth through fourteenth embodiments, respectively, of the present invention.
Figure 8B:
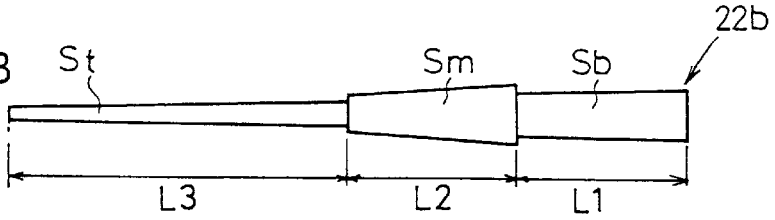
Figure 8C:
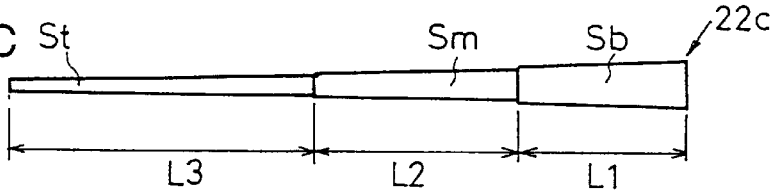
Figure 8D:
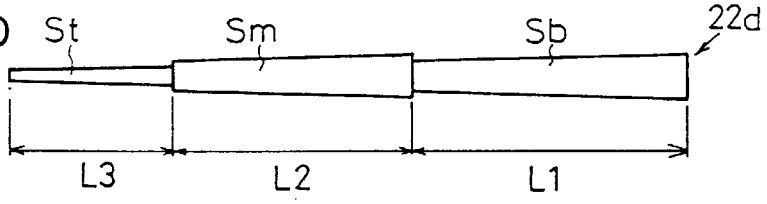
Figure 8E:
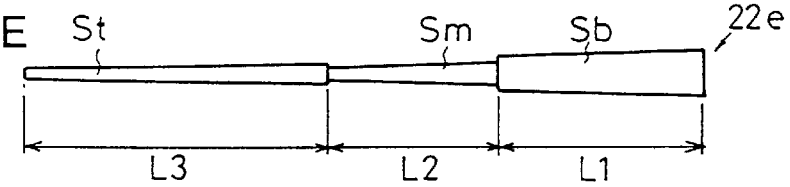
Figure 8F:
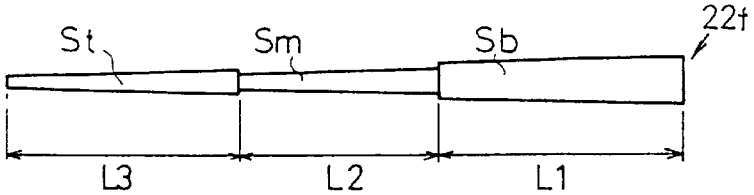
Figure 8G:
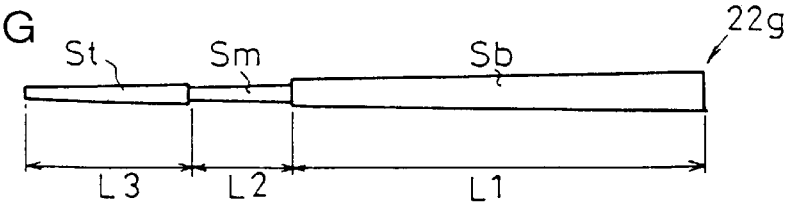

FIGS. 7A~7C show golf club shafts 20*a*~20*c,* respectively, according to fifth, sixth, and seventh embodiments of the present invention.

FIGS. 8A~8G show golf club shafts 22*a*~22*g* according to eighth through fourteenth embodiments, respectively, of the present invention.

In each of the eighth through fourteenth embodiments, the golf club shaft comprises three tubular members Sb, Sm, St, one of which has a length different from the lengths of the other two tubular members. The ratios (%) of lengths L1, L2, L3 of the respective tubular members Sb, Sm, St to the overall length L of the golf club shaft in each of the eighth through fourteenth embodiments are shown in Table given below. The bending points BP and the flexional rigidities of the golf club shafts 22*a*~22*g* can be set to desired positions and values by adjusting the L1, L2, L3 of the respective tubular members Sb, Sm, St.

TABLE

| | L3/L | L2/L | L1/L |
|---|---|---|---|
| 22a | 25 | 25 | 50 |
| 22b | 50 | 25 | 25 |
| 22c | 45 | 30 | 25 |
| 22d | 25 | 35 | 40 |
| 22e | 45 | 25 | 30 |
| 22f | 35 | 30 | 35 |
| 22g | 25 | 15 | 60 |

Figure 9A:
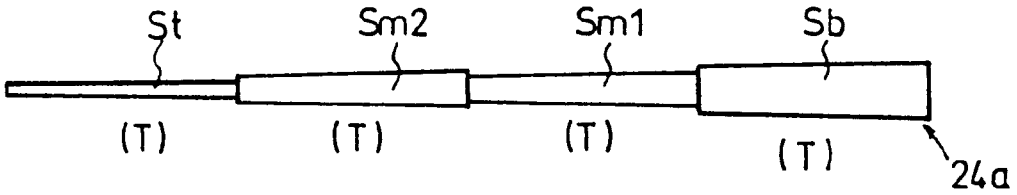
FIGS. 9A and 9B are elevational views of golf club shafts according to fifteenth and sixteenth embodiments, respectively, of the present invention.
Figure 9B:
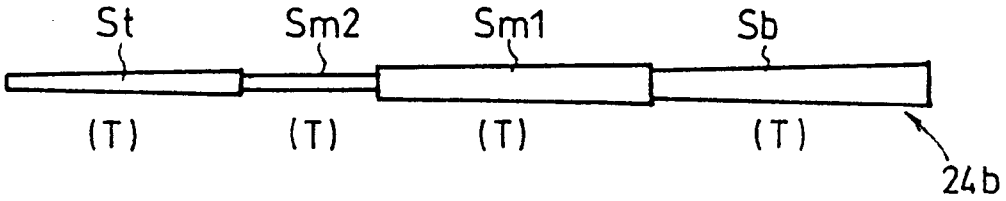

FIGS. 9A and 9B show golf club shafts 24*a,* 24*b* according to fifteenth and sixteenth embodiments, respectively, of the present invention. As shown in FIGS. 9A and 9B, each of the golf club shafts 24*a,* 24*b* comprises four tubular members Sb, $Sm_1$, $Sm_2$, St.

Figure 10A:
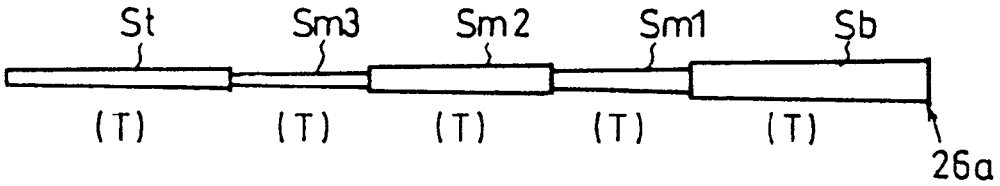
FIGS. 10A and 10B are elevational views of golf club shafts according to seventeenth and eighteenth embodiments, respectively, of the present invention.
Figure 10B:
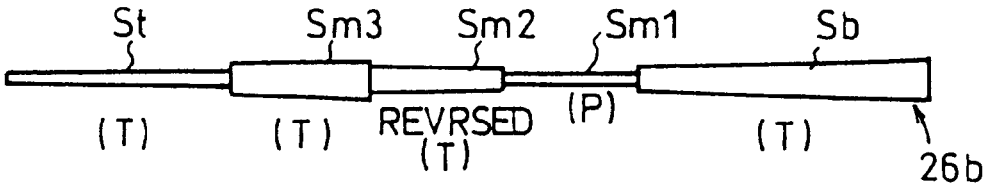

FIGS. 10A and 10B show golf club shafts 26*a,* 26*b* according to seventeenth and eighteenth embodiments, respectively, of the present invention. As shown in FIGS. 10A and 10B, each of the golf club shafts 26*a,* 26*b* comprises five tubular members Sb, $Sm_1$, $Sm_2$, $Sm_3$, St.

Because of the four or five tubular members, a wide variety of distributions of flexional rigidities are available with high freedom for the golf club shafts 24*a,* 24*b,* 26*a,* 26*b.* For example, the golf club shafts 24*a,* 24*b,* 26*a,* 26*b* may be arranged so as to be flexible at the shaft butt end to store energy upon a downswing and also flexible at the shaft tip head end to produce a powerful ball hit for a high ball trajectory.

The golf club shaft according to the present invention is not limited to the illustrated embodiments and examples, but may have other shapes and characteristics based on combinations of numbers, lengths, weights, wall thicknesses, etc. of tubular members.

Although certain preferred embodiments of the present invention has been shown and described in detail, it should be understood that various changes and modifications may be made therein without departing from the scope of the appended claims.

What is claimed is:

1. A golf club shaft comprising:

at least three tubular members including a butt end tubular member as a grip support providing a butt end, a tip end tubular member as a head support providing a tip end, and a middle tubular member disposed between said butt end tubular member and said tip end tubular member, wherein each of said tubular members is constructed by a plurality of wound fiber-reinforced synthetic resin layers;

wherein each of said tubular members is one of: (a) a cylindrical shape having inner and outer diameters which are substantially constant between opposite ends thereof, and (b) a tapered shape having inner and outer diameters which decrease uniformly and progressively from one end to another end thereof;

said butt end tubular member having a flexional rigidity being greater than a flexional rigidity of said tip end tubular member;

said butt end tubular member, said middle tubular member, and said tip end tubular member being co-axially joined together at respective ends thereof;

wherein for each of said tubular members, mating ends of said tubular members have a tapered wall thickness in which said wall thickness decreases to said ends for allowing said mating ends to fit together.

2. A golf club shaft according to claim 1, wherein each of said butt end tubular member, said middle tubular member, and said tip end tubular member is of a tapered shape having a diameter progressively smaller from said butt end toward said tip end.

3. A golf club shaft according to claim 1, wherein each of said butt end tubular member, said middle tubular member, and said tip end tubular member is of a cylindrical shape having substantially the same diameter between opposite ends thereof.

4. A golf club shaft according to claim 1, wherein said middle tubular member is of a tapered shape having a diameter progressively smaller from said tip end toward said butt end.

5. A golf club shaft according to claim 1, wherein said butt end tubular member, said middle tubular member, and said tip end tubular member comprise a combination of tapered and cylindrical tubular members.

6. A golf club shaft according to claim 1, wherein said middle tubular member has an end having a diameter near said butt end which is greater than a diameter of an end of said butt end tubular member near said middle tubular member.

7. A golf club shaft according to claim 1, wherein said middle tubular member has an end having a diameter near said tip end which is smaller than a diameter of an end of said tip end tubular member near said middle tubular member.

8. A golf club shaft according to claim 1, wherein each of said butt end tubular member, said middle tubular member, and said tip end tubular member has a length determined depending on the position of a bending point on the golf club shaft and the flexional rigidity of the tubular member.

9. A golf club shaft according to claim 1, wherein said butt end tubular member, said middle tubular member, and said tip end tubular member have ends overlapping each other.

10. A golf club shaft according to claim 1, wherein each of said butt end tubular member, said middle tubular member, and said tip end tubular member has a length which is at most about 60% of an overall length of the golf club shaft.

11. A golf club shaft according to claim 1, comprising four tubular members axially joined together.

12. A golf club shaft according to claim 1, comprising five tubular members axially joined together.

13. The golf club shaft according to claim 1, wherein at least two of said respective tubular members are made of a different material.

14. The golf club shaft according to claim 1, wherein at least two of said respective tubular members have a different wall thickness.

15. A golf club shaft comprising:

at least three tubular members including a butt end tubular member as a grip support providing a butt end, a tip end tubular member as a head support providing a tip end, and a middle tubular member disposed between said butt end tubular member and said tip end tubular member, a first end of said middle tubular member being co-axially attached to an end of said tip end tubular member and a second end of said middle tubular member being co-axially attached to an end of said butt end tubular member;

wherein the flexional rigidity of the butt end tubular member is greater than the flexional rigidity of the tip end tubular member, and for each of said tubular members, mating ends of said tubular members have a tapered wall thickness in which said wall thickness decreases to said ends for allowing said mating ends to fit together.

16. A golf club shaft according to claim 15, wherein each of said at least three tubular members has a cylindrical shape having inner and outer diameters which are substantially constant between opposite ends thereof.

17. A golf club shaft according to claim 15, wherein each of said at least three tubular members has a tapered shape having inner and outer diameters which decrease uniformly and progressively from one end to another end thereof.

18. A golf club shaft according to claim 15, wherein said middle tubular member has a tapered shape having a diameter progressively smaller from said tip end toward said butt end.

19. A golf club shaft according to claim 15, wherein said butt end tubular member, said middle tubular member, and said tip end tubular member comprise a combination of tapered and cylindrical tubular members.

20. A golf club shaft according to claim 15, wherein said middle tubular member has an end having a diameter near said butt end tubular member which is greater than a diameter of an end of said butt end tubular member near said middle tubular member.

21. A golf club shaft according to claim 15, wherein said middle tubular member has an end having a diameter near said tip end tubular member which is smaller than a diameter of an end of said tip end tubular member near said middle tubular member.

22. A golf club shaft according to claim 15, wherein each of said at least three tubular members has a length determined depending on the position of a bending point on the golf club shaft and the flexional rigidity of the tubular member.

23. The golf club shaft according to claim 15, wherein at least two of said respective tubular members are made of a different material.

24. The golf club shaft according to claim 15, wherein at least two of said respective tubular members have a different wall thickness.

* * * * *